US008915824B2

(12) United States Patent
Roberts

(10) Patent No.: US 8,915,824 B2
(45) Date of Patent: Dec. 23, 2014

(54) THUMB FITNESS DEVICE

(71) Applicant: Russell Roberts, Fort St. John (CA)

(72) Inventor: Russell Roberts, Fort St. John (CA)

( * ) Notice: Subject to any disclaimer, the term of this patent is extended or adjusted under 35 U.S.C. 154(b) by 196 days.

(21) Appl. No.: 13/645,786

(22) Filed: Oct. 5, 2012

(65) Prior Publication Data

US 2013/0090215 A1 Apr. 11, 2013

Related U.S. Application Data

(60) Provisional application No. 61/543,424, filed on Oct. 5, 2011.

(51) Int. Cl.

| | |
|---|---|
| ***A63B 21/00*** | (2006.01) |
| ***A63B 23/14*** | (2006.01) |
| ***A63B 21/02*** | (2006.01) |
| ***A63B 21/04*** | (2006.01) |

(52) U.S. Cl.

CPC ..... *A63B 23/14* (2013.01); *A63B 21/0004* (2013.01); *A63B 21/028* (2013.01); *A63B 21/0414* (2013.01); *A63B 21/1469* (2013.01)

USPC ..... 482/49; 482/69; 482/68; 482/57

(58) Field of Classification Search

USPC ..... 482/49, 68, 69, 57; 280/200

See application file for complete search history.

(56) References Cited

U.S. PATENT DOCUMENTS

| | | | | |
|---|---|---|---|---|
| 4,194,751 | A * | 3/1980 | Shinmura | 280/11.201 |
| 4,798,377 | A | 1/1989 | White | |
| 4,930,798 | A * | 6/1990 | Yamazaki et al. | 280/261 |
| 5,141,478 | A | 8/1992 | Upper | |
| 5,538,268 | A * | 7/1996 | Miller | 280/87.05 |
| 5,634,871 | A | 6/1997 | Froelich, Sr. et al. | |
| D431,060 | S | 9/2000 | Wyrick | |
| 6,251,015 | B1 | 6/2001 | Caprai | |
| 6,338,355 | B1 * | 1/2002 | Cheng | 135/67 |
| D483,306 | S * | 12/2003 | Meinhold | D12/178 |
| 6,877,519 | B2 * | 4/2005 | Fink | 135/67 |
| 7,156,778 | B1 | 1/2007 | Blough | |
| 7,438,669 | B1 * | 10/2008 | Bloom | 482/49 |
| 8,393,246 | B2 * | 3/2013 | Poertner et al. | 74/551.8 |

* cited by examiner

*Primary Examiner* — Jerome W Donnelly

(74) *Attorney, Agent, or Firm* — Buckingham, Doolittles & Burroughs, LLC

(57) ABSTRACT

An exercise device for improving thumb strength in a user of a thumb-driven throttle machine is provided. The exercise device comprises a shaft component, a grip component, and the throttle component, and generally resembles a right side of a handle of a vehicle having a hand throttle mechanism. The exercise device allows a user to exercise a thumb by moving a throttle component from a relaxed position to a position under tension.

19 Claims, 4 Drawing Sheets

THUMB FITNESS DEVICE

CROSS-REFERENCE

This application claims priority from Provisional Patent Application Ser. No. 61/543,424 filed Oct. 5, 2011.

FIELD OF THE INVENTION

This invention pertains generally to a fitness device for a user's thumb, and more particularly to a thumb fitness device for building up strength in the thumbs of users, particularly users of devices which use throttles.

BACKGROUND

For a user of a snow machine, all-terrain vehicle, snow mobile, and the like, or any other device using a thumb-pressed throttle, the constant pushing required by a thumb to keep the machine in motion can lead to significant discomfort over time. Whether the user is new to these types of machines or is just out of practice, the pressure on an untrained thumb can lead to a sore, stiff, and injured digit. The thumb may tire in just a few minutes, as thumb fatigue quickly inhibits keeping the throttle engaged to move the vehicle. This often requires the user to either stop the vehicle or to continue on risking further discomfort and/or injury. Even at rest, the fatigued thumb may continue to ache, making for a less enjoyable experience.

Therefore, a thumb training and/or exercise device to build up the muscle strength required to operate thumb-pressed throttle driven devices would be advantageous. The proposed invention allows a new or out of practice user to get their thumb in condition to operate thumb-pressed throttle driven devices. The invention has the same look and feel of the right side of a handlebar with a throttle mechanism. The device is completely portable, so that the user may exercise his or her thumb at their convenience. Individuals who desire a pain-free experience when using throttle-controlled vehicles will benefit from the training facilitated by the device.

SUMMARY

Accordingly, the present invention overcomes the limitations of the prior art by providing a unique and useful exercise device that allows a user of a thumb-pressed throttle machine to build up thumb strength, thereby decreasing the likelihood of fatigue or injury while using the machine.

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an exercise device for improving thumb fitness. In one embodiment, the exercise device comprises a shaft component, a grip component, and a throttle component. Preferably, the exercise device resembles a right side of a handle of a snow machine or all-terrain vehicle having a throttle mechanism.

The exercise device permits a user to build up the thumb strength required to comfortable operate thumb-throttle mechanisms. The user may grasp the grip component with a hand and operate the throttle component to exercise a thumb. The user may apply pressure to the throttle mechanism with the thumb so the throttle mechanism is moved between an extended position and a depressed position. A tension component connected to the shaft component and the throttle component lengthens when the throttle mechanism is moved to the depressed position creating resistance that the thumb must overcome, thereby building up thumb strength. Once depressed, the throttle component is then released eliminating the resistance, and the exercise may be repeated.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
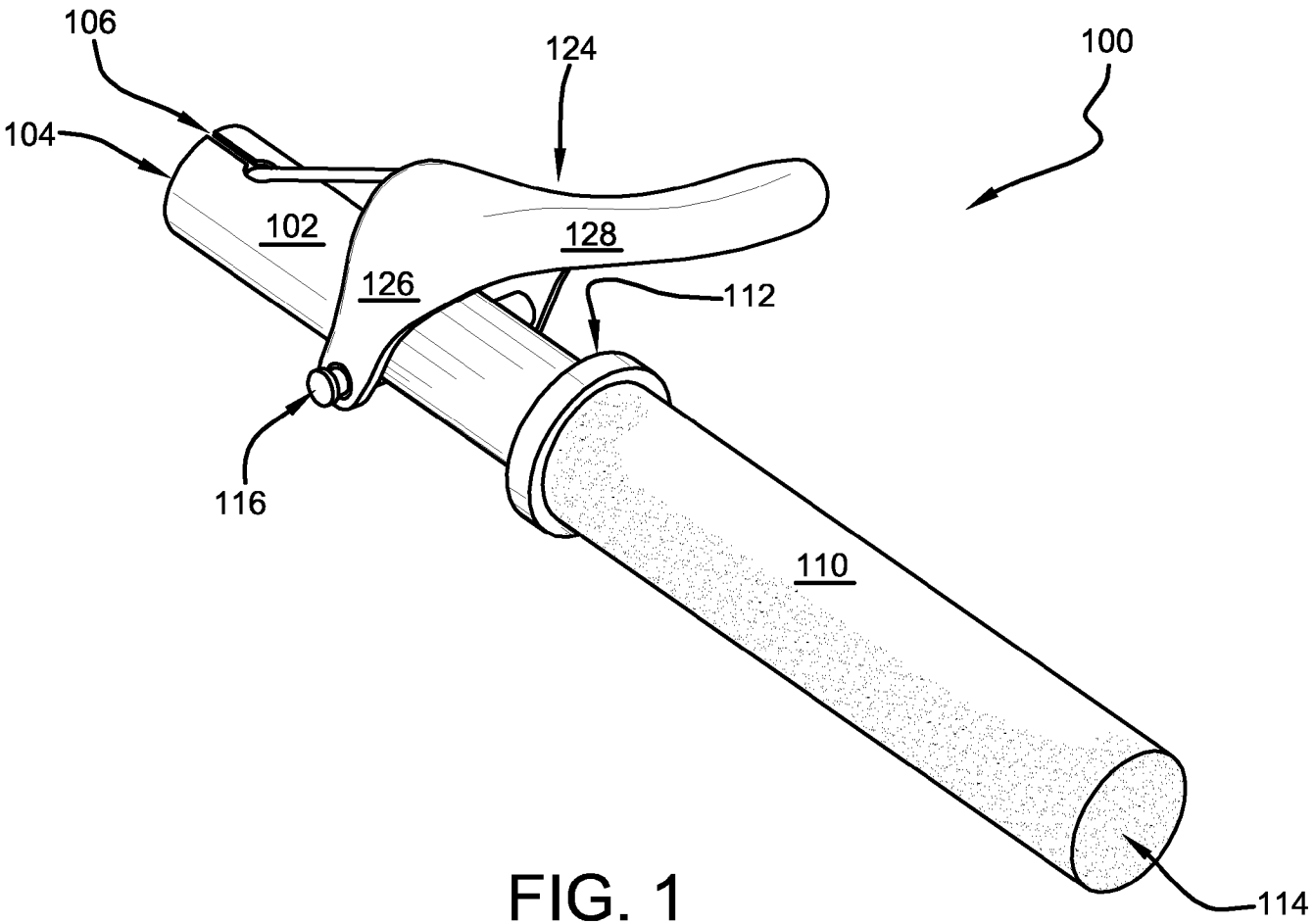
FIG. 1 illustrates a perspective view of an exercise device in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

Referring initially to the drawings, FIG. 1 illustrates an exercise device 100 for exercising a thumb to build up thumb strength in a user of a machine with a throttle. The exercise device 100 resembles a right side of a handlebar of a machine with a throttle such as a snow machine, a snow mobile, an all-terrain vehicle, a snow blower, a lawn mower, and the like, or of any device employing a thumb-driven throttle as is known in the art. The exercise device 100 is portable and comprises a shaft component 102, a grip component 110, and a throttle component 124.

The shaft component 102 generally comprises an approximately seven inch long section of metal tubing approximately one inch in diameter. However, the shaft component 102 may be between approximately six and eight inches in length with a diameter of between approximately ¾ and 1¼ inches as well. Additionally, the shaft component 102 material may comprise steel, aluminum, plastic, polymer, and the like; though any other suitable material may be used to manufacture the shaft component 102 as is known in the art without affecting the overall concept of the invention.

The grip component 110 comprises an open end 112 and a closed end 114. The grip component 110 material may comprise rubber, plastic, polymer, and the like; though any other suitable material may be used to manufacture the grip component 110 as is known in the art without affecting the overall concept of the invention. While the shape of the grip component 110 is generally tubular, it may be shaped like a throttle handgrip, a handlebar grip, a bicycle handgrip, and the like. Similarly, the grip component 110 may comprise any color, texture, or style, as desired as long as it does not affect the function of the exercise device 100. For example, the grip component 110 may be molded to fit the user's hand. Additionally, an inside diameter of the grip component 110 will be slightly larger than an outside diameter of the shaft component 102.

The shaft component 102 further comprises a first end 104, a second end 108, a slit element 106, and an inside portion (not shown). The second end 108 slidably engages with the grip component 110. In other words, the second end 108 slides into the open end 112 of the grip component 110 and bottoms out at the closed end 114 so that the second end 108 is substantially encapsulated by the grip component 110. While the shaft component 102 is generally held in place on the grip component 110 by friction, other methods of holding it in place as are known in the art may be used as well, such as but not limited to adhesives, heat, metal fasteners, and the like.

The throttle component 124 comprises a saddle portion 126 and a handle portion 128. The saddle portion 126 is adjacent to the shaft component 102 with the handle portion 128 extending distally out of the saddle portion 126 as one integral piece. The handle portion 128 generally resembles a depressible throttle lever from a typical prior art machine with a hand throttle. The shape is generally curved, but may also be flat, squared, rounded, grooved, ribbed, molded, and the like, so as to better fit the user's thumb. The saddle portion 126 extends around and partially encapsulates the shaft component 102.

Figure 2A:
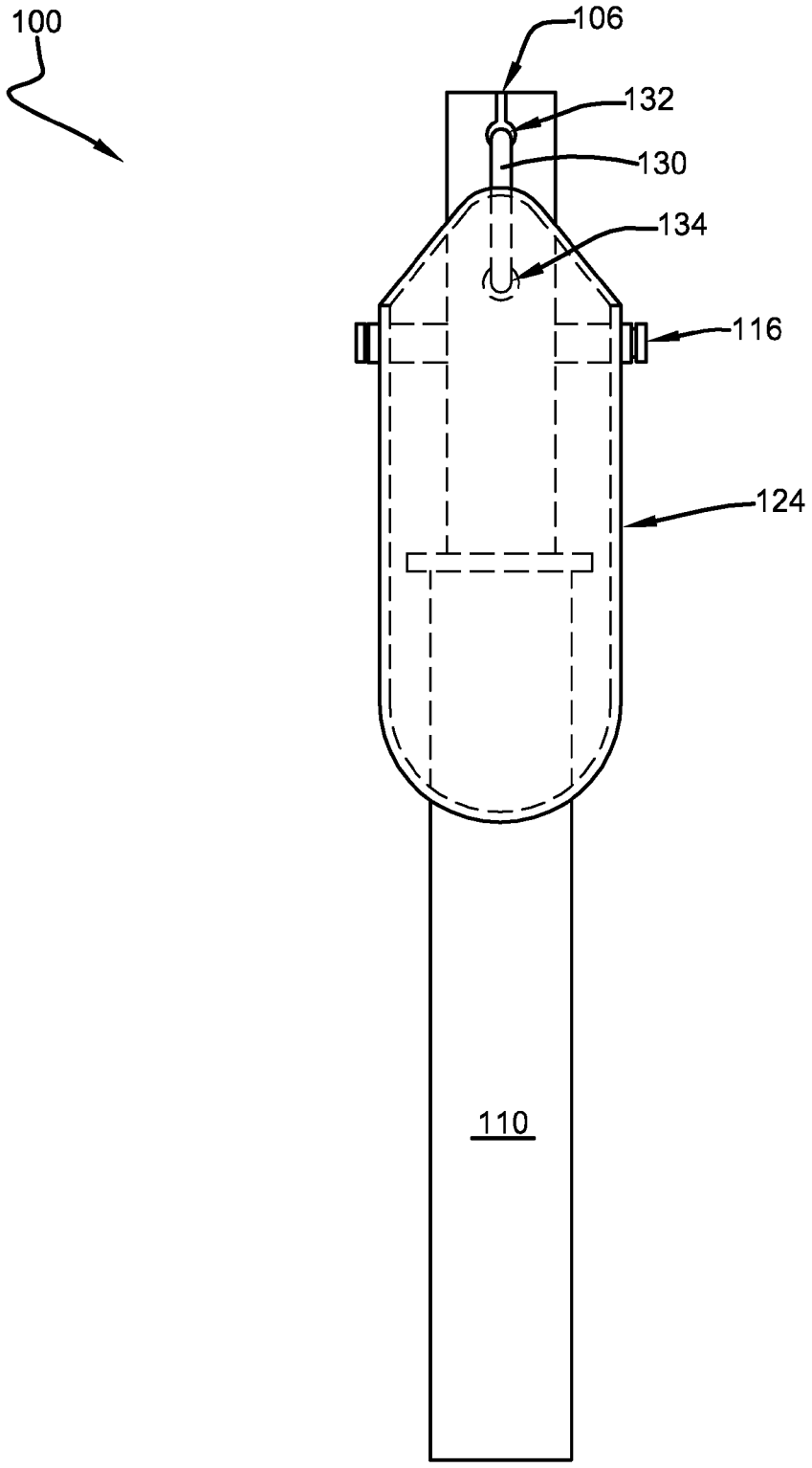
FIG. 2A illustrates a top perspective view of the exercise device in accordance with the disclosed architecture.
Figure 2B:
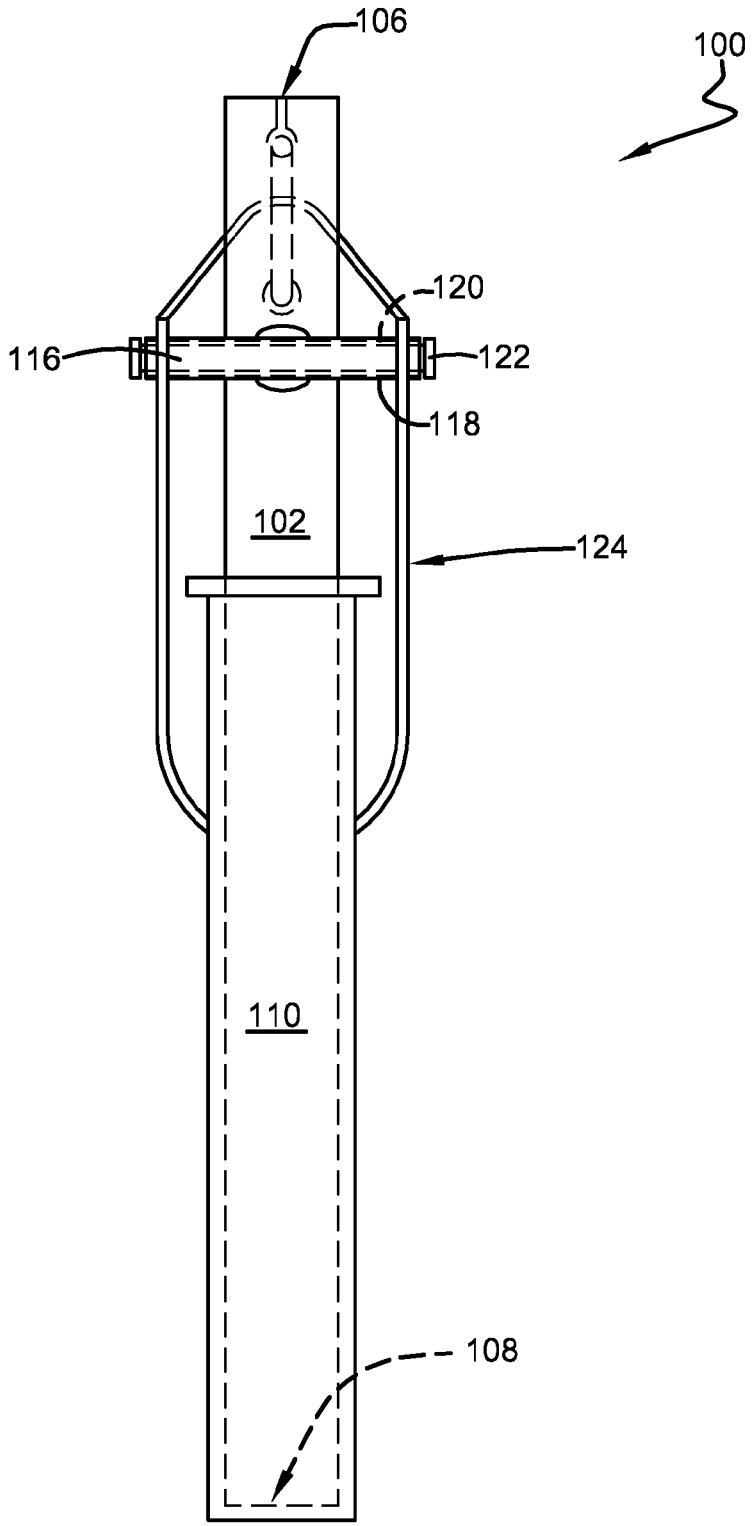
FIG. 2B illustrates a bottom perspective view of the exercise device in accordance with the disclosed architecture.

As illustrated in FIGS. 2A and 2B, the exercise device 100 further comprises a transition component 116 for pivotally connecting the throttle component 124 to the shaft component 102. The transition component 116 comprises a fixed portion 118, a sleeve portion 120, and a pin portion 122. The fixed portion 118 generally comprises a section of hollow tubing which is attached to the shaft component 102 perpendicularly at approximately a midpoint of the hollow tubing. The fixed portion 118 may be attached by spot welding, braising, soldering, adhesive, or be molded into the shaft component 102, and the like or by any other methods of holding it permanently in place as are known in the art. Alternatively, the section of hollow tubing could be T-shaped with a base of the T-shape being attached to the shaft component 102.

The sleeve portion 120 is generally a section of Teflon® tubing of a slightly smaller diameter than an inside of the fixed portion 118 and is inserted within the fixed portion 118. Although Teflon® is a preferred material for the sleeve portion 120, any other similar material such as but not limited to, plastic, polymer, and metal may be used as well. Next the pin portion 122 is typically a metal or plastic pin that is inserted through the sleeve portion 120 and extends through a pair of sides of the saddle portion 126 so that the saddle portion is permanently affixed to the transition component 116 thereby completely encircling the shaft component 102. The pin rotates within the sleeve portion 120 so that the throttle component 124 may pivot when downward pressure is applied by the thumb on the handle portion 128.

The exercise device 100 further comprises a tension component 130 that adjustably connects the shaft component 102 and the throttle component 124. The tension component 130 comprises a first end 132 and a second end 134. The first end 132 is attached to the inside portion of the shaft component 102 and extends through the slit element 106. The slit element 106 is generally notched in appearance for aligning the tension component 130 along the shaft component 102 toward the throttle component 124. The second end 134 of the tension component 130 is attached to the saddle portion 126 of the throttle component 124 so that the tension component 130 is generally taut when in use, but is relaxed or not under tension in a non-use position. Attachment of the first end 132 and the second end 134 may be with a knot, adhesive, mechanical fastener, or by any means of attachment as discussed supra. The tension component 130 is generally a section of surgical tubing, but any similar stretchable material may be used as well.

Figure 3:
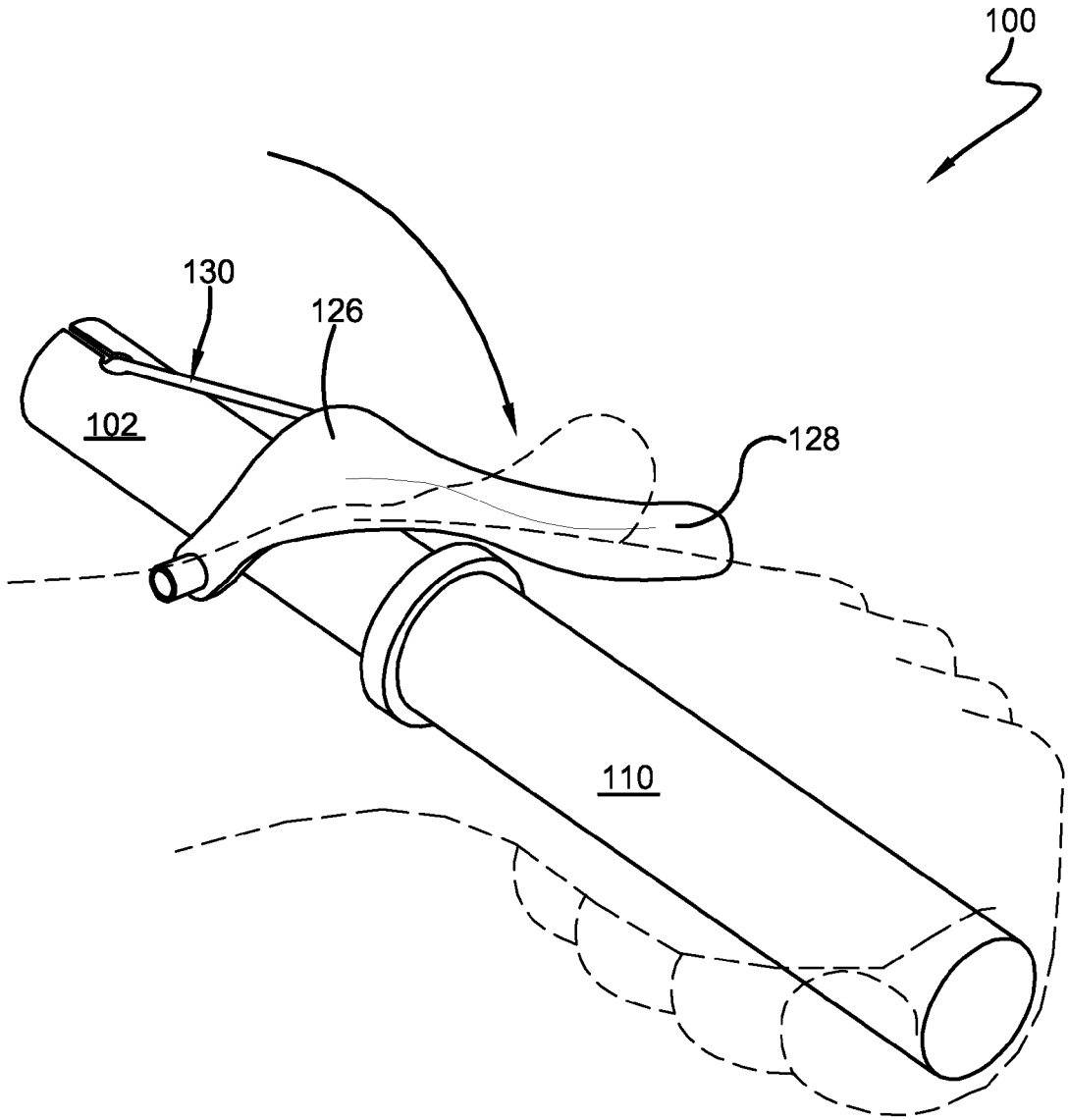
FIG. 3 illustrates a perspective view of the exercise device with a throttle component moved to a depressed position in accordance with the disclosed architecture.

When utilized, as illustrated in FIGS. 1 and 3, the user grasps the grip component 110 with the hand and applies a downward pressure to the throttle component 124 with the thumb, in a similar motion to engaging the throttle of a snow mobile, thereby moving the throttle component 124 between an extended position and a depressed condition as illustrated in FIG. 3. Prior to receiving pressure, the throttle component 124 is in the extended position with the handle portion 128 approximately perpendicular to the shaft component 102. Once in the depressed position, the handle portion 128 is approximately parallel to the shaft component 102. In the depressed condition the tension component 130 stretches and extends approximately between one and two inches in length. The particular material of the tension component 130 will determine the amount of resistance that the user will have to overcome. As the user depresses the handle portion 128, the throttle component 124 resists the movement thereby performing the exercise. As the handle portion 128 is released by the thumb, the handle portion 128 returns to the extended position and is no longer stretched or under tension. The exercise may be repeated as many times as desired to build up thumb strength.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An exercise device comprising:

a shaft component;

a grip component slideably engaged with the shaft component; and a throttle component pivotally connected to the shaft component movable between an extended position and a depressed position; and a tension component for resisting movement of the throttle component toward the depressed position when depressed by a thumb, the tension component fixedly attached to the shaft component and the throttle component, wherein the tension component is surgical tubing.

2. The exercise device of claim 1, wherein the shaft component comprises metal tubing approximately between six and eight inches in length.

3. The exercise device of claim 1, wherein the grip component comprises a throttle handgrip, a handlebar grip, a bicycle handgrip, or a rubber handgrip.

4. The exercise device of claim 1, wherein the exercise device material comprises: rubber, plastic, polymer, metal, carbon fiber, or polytetrafluoroethylene.

5. The exercise device of claim 1, wherein the throttle component comprises a saddle portion adjacent to the shaft component and a handle portion distal to the shaft component.

6. The exercise device of claim 1, wherein the exercise device is portable.

7. An exercise device for exercising a thumb, the exercising device comprising:

a shaft component;

a grip component frictionally engaged with the shaft component; and a throttle component pivotally connected to the shaft component so that the throttle component is moveable between an extended position and a depressed position, wherein the depressed position resists movement of the throttle component when pressed by a thumb; and a tension component fixedly attached to the shaft component and the throttle component, wherein the tension component is surgical tubing.

8. The exercise device of claim 7, wherein the throttle component in the extended position is approximately perpendicular to the shaft component.

9. The exercise device of claim 8, wherein the throttle component in the depressed position is approximately parallel to the shaft component.

10. The exercise device of claim 9, wherein the throttle component comprises a saddle portion that partially encircles the shaft component and a handle portion distal to the shaft component.

11. The exercise device of claim 7, wherein the tension component adjustably connects the shaft component to the throttle component.

12. The exercise device of claim 11, wherein the shaft component comprises a notch for aligning the tension component along the shaft component.

13. The exercise device of claim 10, wherein the saddle portion of the throttle component is connected to the shaft component with a transition component holding the throttle component in place on the shaft component.

14. The exercise device of claim 13, wherein the transition component is affixed to the shaft component and comprises a fixed portion, a sleeve portion, and a pin portion.

15. An exercise device for building up thumb strength in a user of a machine with a throttle, the exercising device comprising:

a shaft component;

a grip component frictionally engaged with the shaft component;

a throttle component pivotally connected to the shaft component so that the throttle component is moveable between an extended position and a depressed position, wherein the depressed position resists movement of the throttle component when pressed by a thumb, and wherein the throttle component returns to the extended position once released; and a tension component fixedly attached to the shaft component and the throttle component, wherein the tension component is surgical tubing.

16. The exercise device of claim 15, wherein the tension component extends approximately between one and two inches in length when under tension.

17. The exercise device of claim 15, wherein a first end of the tension component is attached to an inside portion of the shaft element.

18. The exercise device of claim 17, wherein the tension component extends out of the inside portion of the shaft component, and a second end of the tension component attaches to the throttle component.

19. The exercise device of claim 15, wherein the throttle component is moveable between an extended position approximately perpendicular to the shaft component and a depressed position approximately parallel to the shaft element, and wherein the depressed position resists movement of the throttle element.

* * * * *